United States Patent [19]

Poulton

[11] Patent Number: 4,883,201

[45] Date of Patent: Nov. 28, 1989

[54] MATERIALS HANDLING EQUIPMENT

[75] Inventor: Barrie Poulton, Cheltenham, England

[73] Assignee: Flomat Ltd., England

[21] Appl. No.: 183,642

[22] Filed: Apr. 19, 1988

[30] Foreign Application Priority Data

Jun. 8, 1987 [GB] United Kingdom ..... 8713392

[51] Int. Cl.[4] ..... B65D 35/56

[52] U.S. Cl. ..... 222/105; 222/181; 248/579

[58] Field of Search ..... 222/95, 94, 103, 97, 222/105, 181, 386.5; 383/111; 248/579

[56] References Cited

U.S. PATENT DOCUMENTS

| | | | |
|---|---|---|---|
| 1,374,459 | 4/1921 | Lichty | 248/579 X |
| 2,975,573 | 3/1959 | Boal | 248/579 X |
| 3,228,558 | 1/1966 | Doyle et al. | 222/386.5 X |
| 3,424,422 | 1/1967 | Klangos | 248/579 X |
| 3,961,655 | 6/1976 | Naitrass et al. | 222/181 X |
| 4,314,788 | 2/1982 | Williams et al. | 414/393 X |
| 4,449,646 | 5/1984 | Bonerb et al. | 222/95 |
| 4,527,716 | 7/1985 | Haas et al. | 222/181 X |
| 4,541,765 | 9/1985 | Moore | 222/95 X |
| 4,690,307 | 9/1987 | Hogan | 222/181 X |

*Primary Examiner*—Joseph J. Rolla
*Assistant Examiner*—Boris Milef
*Attorney, Agent, or Firm*—Wallenstein Wagner & Hattis, Ltd.

[57] ABSTRACT

There is disclosed apparatus for facilitating discharge of material from a bag having an inner liner. A cord is provided which can be extended from resilient return reel for connection with the top of the liner so that the liner is pulled as the bag empties.

6 Claims, 2 Drawing Sheets

MATERIALS HANDLING EQUIPMENT

DESCRIPTION

1. Technical Field

This invention concerns equipment for handling powdered, granulated or other particulate solid materials, and more especially, equipment of the kind (hereinafter termed "of the kind referred to") used to assist the discharge of such materials from intermediate bulk containers adapted to be used repeatedly and popularly referred to within the industry as "multi-trip big bags".

2. Background Prior Art

Intermediate bulk containers in the form of large bags having an inner liner are becoming increasingly commonly used for the storage and dispensing of bulk particulate solids. Those adapted for repeated use have a tubular spout on their underside which must be untied and released to permit discharge.

The inner liner serves many purposes. The outer bag can be used many times without risk of contamination by inserting a replacement liner each time the bag is used. The inner liner prevent egress of very fine powders through the weave or seams of the outer bag. The liner prevents ingress of water to the product during transport of the bag and gives some measure of protection to the product if the outer bag should become damaged.

A major disadvantage of using an internal liner is the problem that occurs during the discharge of material from the bag. The common practice of discharging a bag is simply to hang the bag by four loops, open the spout on the outer bag, and unfasten the goose-neck of the internal liner, thus allowing the product to discharge freely or through a discharging machine. As the bag discharges, the level of material eventually drops to a point where there is insufficient pressure to hold the liner against the walls of the bag, with the result that the liner slips and blocks the discharge outlet, or alternatively the liner drops through the spout and runs the risk of becoming entangled with the handling equipment below.

Various attempts to overcome this disadvantage have involved tying the upper end of the liner to support means before discharge, but these have not proved wholly satisfactory since the liner can still collapse and interfere to some extent with discharge.

It is an object of the present invention to provide means to overcome the problem aforesaid.

SUMMARY OF THE INVENTION

According to the present invention, there is provided equipment of the kind referred to comprising frame members to which the upper end of the outer bag of an intermediate bulk container can be anchored and including cord means extendable against resilient means and adapted to be connected with the upper end of an inner liner to the outer bag.

As the bag is discharged, the cord means pulls the liner upwardly and ensures that it cannot collapse inwardly to interfere with or arrest discharge.

The cord means may extend over a pulley means having notches on the periphery thereof sized to accommodate any knotted connection between the cord and the inner liner.

The invention will be further apparent from the following description, with reference to several Figures of the accompanying drawings, which show, by way of example only, one form of equipment of the kind referred to embodying same.

DETAILED DESCRIPTION

Figure 1:
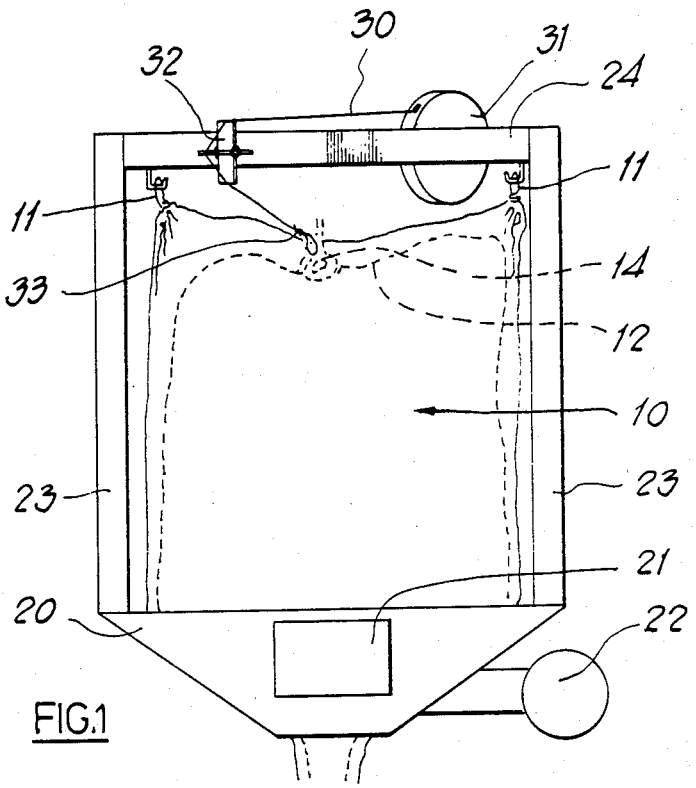
FIG. 1 shows a side elevation of the equipment.
Figure 2:
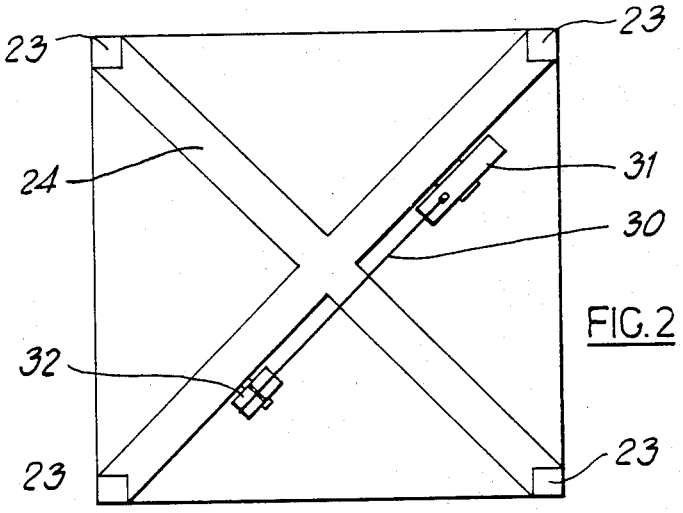
FIG. 2 shows a plan view of the equipment of FIG. 1.
Figure 3:
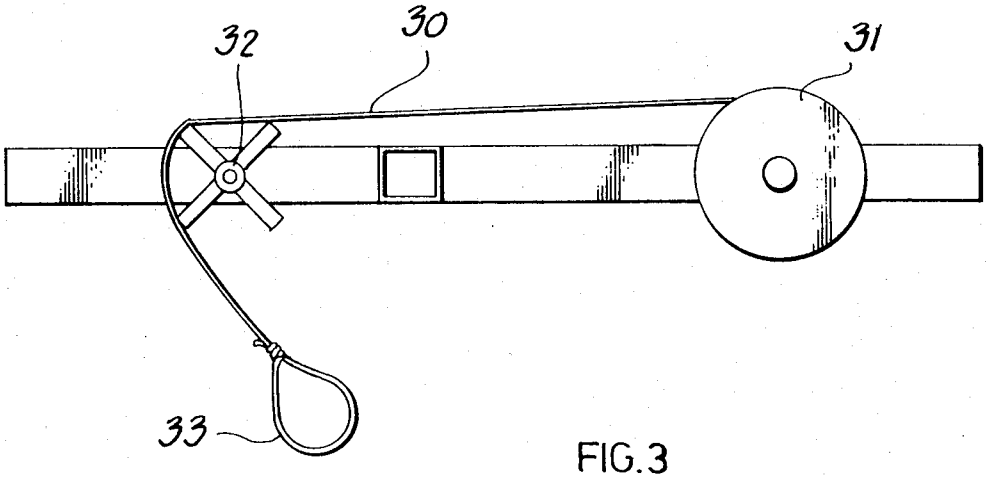
FIG. 3 shows a detail of the equipment of FIGS. 1 and 2 on an enlarged scale.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring now to the drawings, it will be seen that the discharge equipment comprises a shallow hopper 20 of square shape adapted to receive the lower end of the bag 10 and having a door 21 through which access may be had by an operator to untie and release the discharge spout of the bag 10 and also equipped with motor-driven eccentric weight vibration means 22.

Four posts 23 extend upwardly from the corners of the hopper 20, respectively, and removably support a cruciform frame 24.

After an intermediate bulk carrier has been positioned on hopper 20, loops 11 on the upper end of the bag 10 are connected with the frame 24. This operation is known as "rigging".

In accordance with the invention, a cord 30 may be deployed outwardly against resilient return means from a reel 31. The cord passes over a rotationally-mounted, four-vane spider member 32 and may be led into the interior of the outer bag through an opening (not shown) for connection with the top of the inner liner 12 by means of a slip knot 33.

In use, as the inner liner empties, the slack in same is taken up and the upper end of the inner liner is drawn outwardly from the outer bag over the spider and towards the reel. The gaps between adjacent vanes of the spider are sufficiently large to accommodate any knotted 14 connection between the cord and the liner.

Typically, the arrangement will exert a force of from 3–5 kgms and enable up to 60 cm or so of liner to be withdrawn from the bag.

It will be appreciated that it is not intended to limit the invention to the above example only, many variations, such as might readily occur to one skilled in the art, being possible, without departing from the scope thereof.

While the specific embodiments have been illustrated and described, numerous modifications come to mind without significantly departing from the spirit of the invention and the scope of protection is only limited by the scope of the accompanying claims.

I claim:

1. Apparatus for discharging particulate solid material from an intermediate bulk container in the form of an outer bag having an inner liner comprising frame members having means to which an upper end of said outer bag can be anchored, means for removing slack from said inner liner by withdrawing said inner liner from said outer liner, said means comprising a reel having resilient return means and a cord means on said reel and extendable against the action of said resilient return means and adapted to be connected with an upper end of the inner liner.

2. Apparatus for discharging particulate solid material from an intermediate bulk container in the form of an outer bag having an inner liner comprising frame members having means to which an upper end of said outer bag can be anchored, a reel having resilient return means and a cord means on said reel and extendable against the action of said resilient return means and adapted to be connected with an upper end of the inner liner and pulley means having notches on the periphery thereof sized to accommodate a knotted connection between the cord means and the inner liner.

3. Apparatus according to claim 2, wherein said pulley means comprises a rotationally-mounted vaned spider.

4. Apparatus according to claim 3, wherein said spider has four vanes.

5. Apparatus according to any one of claims of 1, 3, 4 and 2, wherein the resilient return means exerts a force of from 3 to 5 kgms.

6. Apparatus according to claim 1 and 2 further including a hopper for receiving the lower end of a intermediate bulk container with said frame members supported above said hopper.

* * * * *